United States Patent [19]

Pippen et al.

[11] Patent Number: 4,747,745

[45] Date of Patent: May 31, 1988

[54] SELECTIVE BEAM GANTRY CRANE

[75] Inventors: Harvey J. Pippen, Longview, Tex.; Donald W. Schaper, Alliance, Ohio

[73] Assignee: Marathon LeTourneau Company, Longview, Tex.

[21] Appl. No.: 36,346

[22] Filed: Apr. 9, 1987

Related U.S. Application Data

[63] Continuation-in-part of Ser. No. 800,273, Nov. 21, 1985, abandoned.

[51] Int. Cl.[4] ..... B66C 13/06

[52] U.S. Cl. ..... 414/460; 212/147; 212/208; 212/220

[58] Field of Search ..... 212/146, 147, 148, 218, 212/219, 220, 213, 205, 221, 208; 414/137, 139, 140, 460, 622, 459; 294/81.1, 81.3, 81.4

[56] References Cited

U.S. PATENT DOCUMENTS

| | | | |
|---|---|---|---|
| 3,146,903 | 9/1964 | Bjorklund | 414/460 |
| 3,176,853 | 4/1965 | Baudhuin et al. | 212/220 |
| 3,241,686 | 3/1966 | Hurst | 212/147 X |
| 3,396,858 | 8/1968 | Baker | 212/220 X |
| 3,558,172 | 1/1971 | Lamer et al. | 414/459 X |
| 4,273,242 | 6/1981 | Schaper | 212/147 |
| 4,279,347 | 7/1981 | Appleman | 212/220 X |

FOREIGN PATENT DOCUMENTS

| | | | |
|---|---|---|---|
| 2410807 | 9/1975 | Fed. Rep. of Germany | 212/221 |
| 2253699 | 7/1975 | France | 212/219 |
| 2265664 | 10/1975 | France | 212/147 |
| 2295904 | 7/1976 | France | 212/147 |
| 2430387 | 2/1980 | France | 212/147 |
| 925846 | 5/1982 | U.S.S.R. | 212/146 |

*Primary Examiner*—Frank E. Werner
*Attorney, Agent, or Firm*—Vinson & Elkins

[57] ABSTRACT

A self-mobile gantry frame has disposed thereon a trolley suspending a load lifting frame. The load lifting frame is stabilized against sway in a direction perpendicular to the gantry beam by a stabilizing beam selectively engageable with the load lifting frame.

19 Claims, 3 Drawing Sheets

SELECTIVE BEAM GANTRY CRANE

This is a continuation of application Ser. No. 800,273, filed Nov. 21, 1985, now abandoned.

BACKGROUND OF THE INVENTION

Self-mobile gantry cranes are used for handling cargo containers, truck trailers and other bulky cargo in dock yards, rails yards, and other areas. Typically these cranes include an elevated horizontal gantry beam supported above the ground on legs, forming an inverted "U" shaped frame. The gantry crane is moveable longitudinally on fixed rails, tracks or guidable wheels. The hoisting operation is accomplished by a winch or similar device which raises and lowers cables attached to a lifting frame, hook or other load engaging means from which the load is suspended. Typically, the load carrying cables are attached to one or more trolleys which run transversely along the horizontal gantry beam. This arrangement permits the load to be moved vertically by the hoisting apparatus, transversely by the trolley and longitudinally by moving the entire gantry structure along the ground on its rails or wheels.

Because the load is suspended on flexible cables, longitudinal or transverse movement of the hoisting apparatus tends to cause sway of the load being carried. While excessive sway is not desirable, a certain amount of sway can be accommodated when handling cargo containers and most other bulky cargo. However, when the gantry cranes are being used to handle truck trailers, especially in the operation of placing truck tailer bodies on flatbed rail cars for "piggyback" shipping, sway of the load is particularly undesirable. This is because the truck trailer bodies must be accurately positioned with respect to a "fifth wheel" on the flatbed rail car to which the truck trailers are attached for rail shipment. Therefore, when handling truck trailer bodies, it is customary to provide means on the gantry crane for stabilizing the load against sway.

In the past, efforts to reduce the sway of loads suspended from such gantry crane apparatus have included reeving arrangement in which the hoisting cables diverge outwardly and upwardly and thus tend to resist sway. See, for example, U.S. Pat. No. 3,825,128 and 3,086,661. Other patents have suggested the use of a separate stabilizing system (U.S. Pat. Nos. 3,746,182, 4,273,242) and the use of tag lines (U.S. Pat. No. 3,352,324). Probably the most successful solution has been to provide a horizontal stabilizing beam which is guided on the gantry legs and raised and lowered along with the load lifting frame to provide a stabilizing support. Such structures are shown in U.S. Pat. Nos. 3,161,309, 3,176,853 and 3,251,496.

The use of a horizontal stabilizing beam which rises and falls with the lifting apparatus handling the cargo is not desirable, however, on so-called "combination" gantry cranes which are adapted to handle both truck trailer bodies and cargo containers. This is because, when handling cargo containers, the gantry frame customarily is moved across several rows of containers at one time. The presence of the horizontal stabilizing beam at the top of the load lifting frame prevents the frame from being lowered below the top of the highest row of containers and thus makes it impossible to handle containers lower thwn the highest container in any row over which the gantry frame is operating. For this reason, so-called combination gantry frames typically have included stabilizing devices which are disposed only above the lifting frame itself and which do not extend transversely between the legs of the gantry frame. See, for example, the stabilizing device of U.S. Pat. No. 4,273,242.

SUMMARY OF THE INVENTION

The present invention provides an improved hoisting apparatus in which a stabilizing means may be selectively engaged with the lifting frame of the hoisting apparatus. The stabilizing means may be engaged operatively with the lifting frame when particular stability of the load being handled is desired as, for example, when handling truck trailer bodies. When the crane is being used to handle loads where stability against sway is less critical, or when the stabilizing device might interfere with operation of the gantry crane (as, for example, when handling cargo containers) the stabilizing device may be moved to an inoperative position.

It is, therefore, the primary object of the present invention to provide an improved hoisting apparatus in which the lifting frame and the load carried thereby may be selectively stabilized against sway.

A further object is to provide such an apparatus in which the means for stabilizing the lifting frame and load against sway comprises a stabilizing beam guided for vertical movement in a gantry frame, but which may be selectively retained in a raised, inoperative, position.

A still further object is the provision of such an apparatus in which the stabilizing beam is an idler beam which does not require the provision of independent hoisting apparatus for raising the lowering the stabilizing beam.

A further object is to provide such an apparatus including means for retaining the idler stabilizing beam always in a substantially horizontal position.

A still further object is to provide a self-mobile gantry crane adapted for handling both cargo containers and truck trailers which includes means for selectively stabilizing the loads being handled against sway in a direction generally perpendicular to the longitudinal axis of the gantry beam.

BRIEF DESCRIPTION OF THE DRAWINGS

These and other objects and advantages of the invention will be apparent from the drawings, specification and claims. In the accompanying drawings, in which like numerals indicate like parts:

DESCRIPTION OF THE PREFERRED EMBODIMENT

Figure 1:
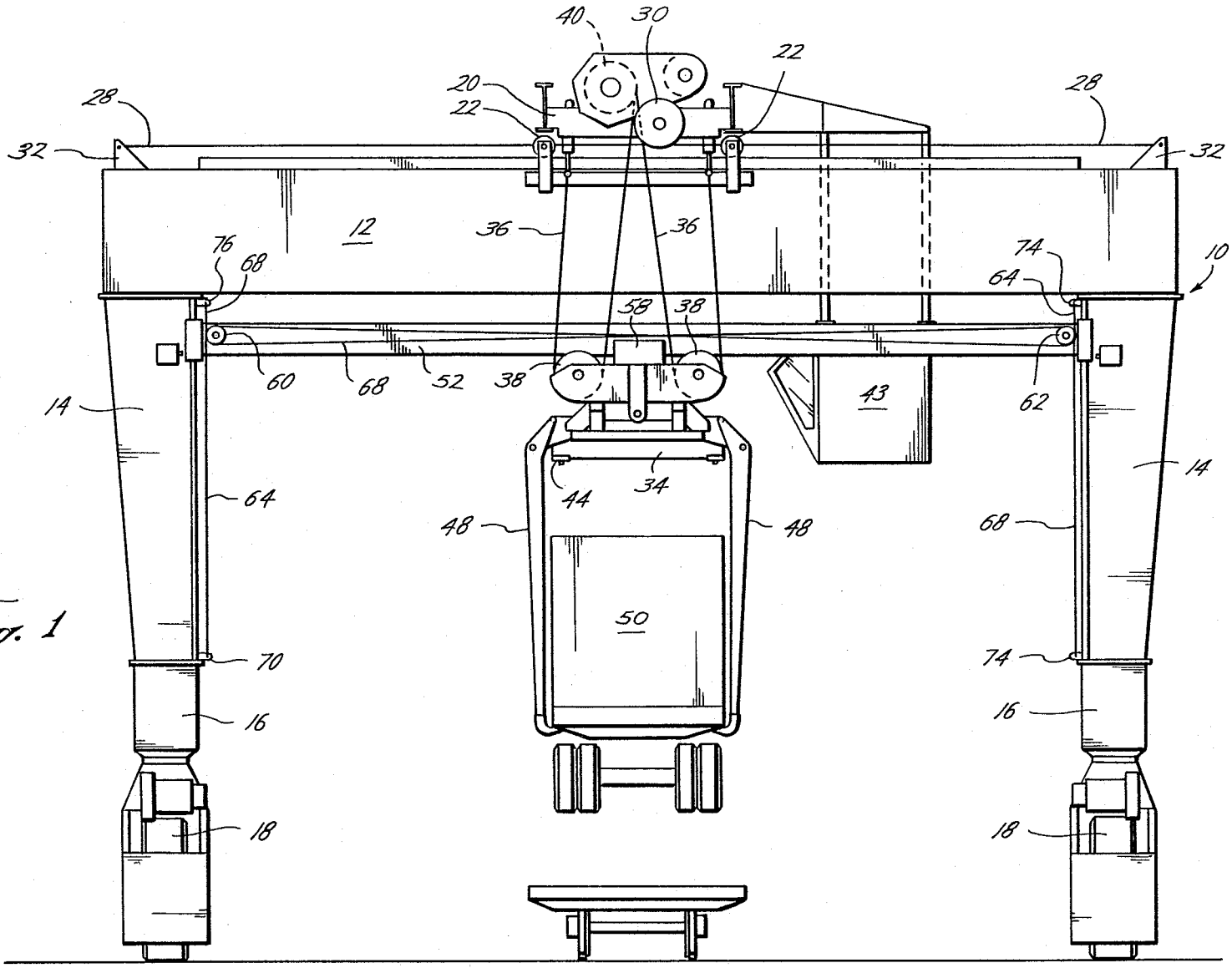
FIG. 1 is a view in front elevation of a large, moveable, hoisting apparatus in accordance with the present invention being used to place a truck trailer onto a railway flatcar.
Figure 2:
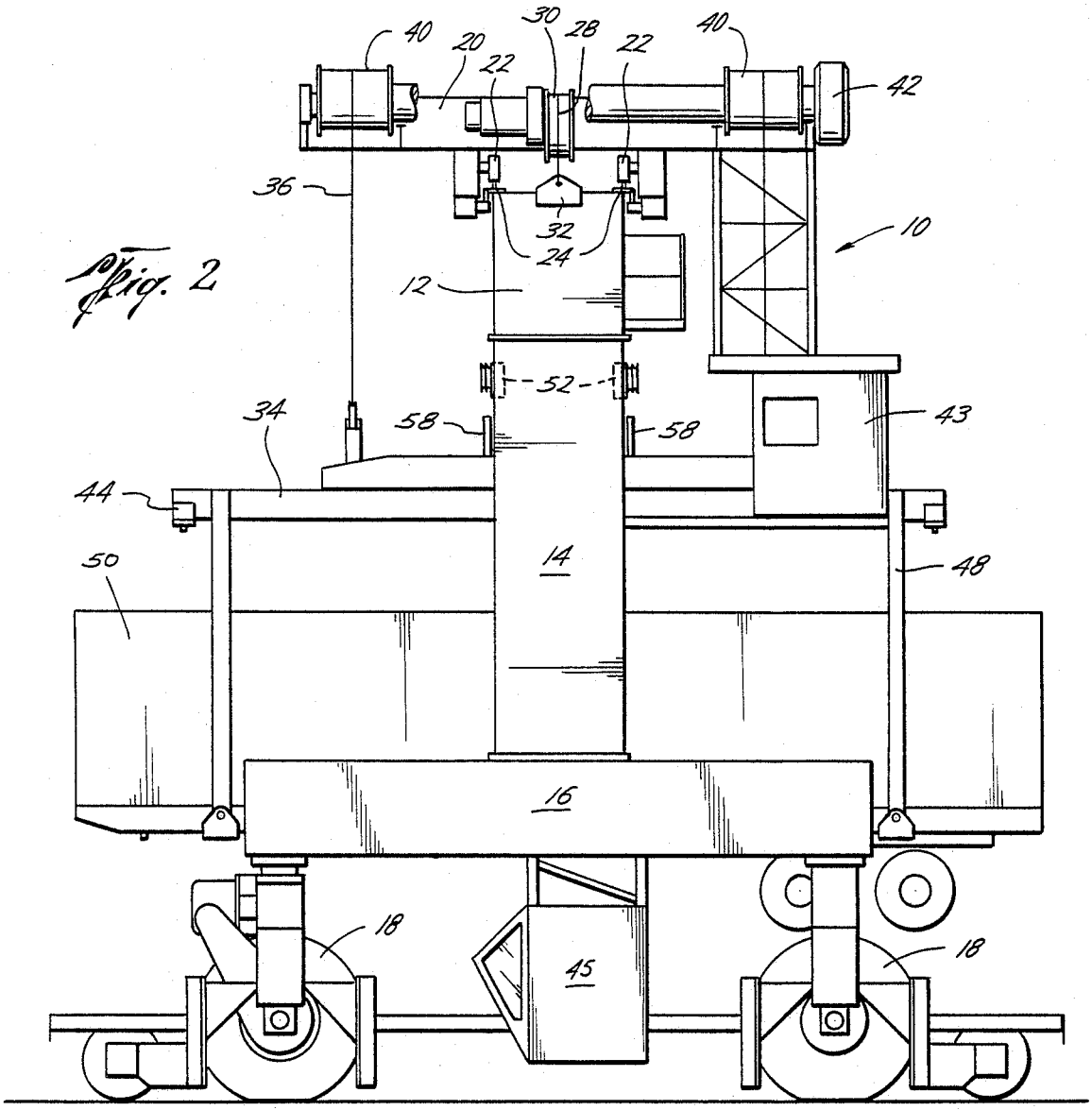
FIG. 2 is a view in side elevation of the apparatus of FIG. 1.

Referring to FIG. 1, there is illustrated a moveable hoisting apparatus or gantry crane 10 which comprises a supporting structure including a substantially horizontal transverse support member or gantry beam 12 supported at its outer ends by a pair of generally vertical legs 14. Each of the legs 14 has its lower end resting on a horizontal frame member 16. The horizontal frame members 16 are supported on guidable, moveable, wheels 18 so that a unitary gantry structure is provided which may move along the ground in any desired direction. Self-contained power means (not shown) such as a diesel engine are provided for powering the wheels 18 for movement, as well as for operating hoisting wenches and for other power requirements for the gantry crane.

A moveable trolley 20 is positioned on top of the transverse beam 12. The trollery 20 is mounted on four rollers or wheels 22 which travel along two rails 24 fixed to the upper outer edges of the transverse beam 12. Lower wheels 26 on the trolley engage the undersides of the rails to prevent the trolley from being tipped over by uneven loading.

The trolley 20 may be powered for movement longitudinally of the beam 12 and rails 24 in any desired manner. Preferably, the trolley is powered by a flexible cable 28 extending generally parallel to the beam 12 and driven by a powered wench 30 on the trolley about which the cable is wound. The cable 28 is attached to the transverse beam 12 at each outer end by means of brackets 32, so that the trolley, and the load suspended therefrom, will move to the right or left across the beam 12 depending upon the direction of rotation of the wench 30.

A load carrying body, or lifting frame 34, is suspended from the trolley 20 by means of flexible cables 36 attached at their outer ends to the trolley 20, reeved about idler sheaves 38 on the lifting frame 34 and then about a pair of cable reels 40 on the trolley. An electric motor 42 is adapted to drive the cable reels to reel in or pay out additional lengths of the cable 36 to thereby raise or lower the lifting frame relative to the transverse gantry beams 12.

Preferably, two control booths are provided on the gantry crane 10. The upper booth 43 is suspended from, and moves with, the trolley 20. The lower booth 45 is suspended from one of the horizontal frame members 16. All functions of the gantry crane may be controlled from either booth so that only a single operator is needed for the crane under most circumstances. The dual operating booths merely provide a choice of vantage points, depending upon the work being done.

The lifting frame 34 is provided with load engaging means including four corner latches 44 adapted to engage latch receiving recesses (not shown) in the upper surface of cargo containers 46. The lifting frame also includes four pivoted lifting arms 48 adapted for bottom lifting of loads, such as truck trailer bodies 50 or cargo containers or other loads not provided with special latch receiving recesses. When not in use, the bottom lifting load arms 48 may be pivoted into a raised position (FIG. 4) where they will not interfere with the operation of the corner latches 44. The construction and operation of the corner latches 44 and the lifting arms 48 are conventional and are shown, for example, in U.S. Pat. No. 3,558,172.

Since the lifting frame 34 and any load carried by it are suspended by the flexible cables 36, movement of the frame and load, either longitudinally of the beam 12 by movement of the trolley 20, or by moving the entire gantry crane structure on its wheels 18, tends to cause sway of the lifting frame 34 and its load, Sway inducing forces are generated by inertia of the cargo and lifting frame and also may be exerted by wind, gravity, or other means. Sway in a direction generally parallel to the transverse beam 12 tends to be minimized because of the angles at which the suspending cables 36 extend between the idler sheaves 38 on the lifting frame and the cable reel 40 on the trolley. However, sway in a direction generally perpendicular to the transverse beam 12 still may occur. Therefore, a separate stabilizing means is desirable to prevent sway of the lifting frame and load in a direction generally perpendicular to the gantry beam 12.

The stabilizing means of the present invention comprise a stabilizing beam 52 extending between the legs 14 of the gantry crane. At opposed ends of the beam 52 are guide members 54 received on vertical guide bars 56 mounted on the gantry legs 14. The beam 52 thus may more freely in a vertical direction but is guided against displacement in other than a vertical direction. Preferably, a pair of such stabilizer beams 52 are provided, one disposed on each side of the legs 14, although the objects of the invention may be accomplished by a single beam.

The guide beams 52 preferably are idler beams and are adapted, when in an unlatched position, to rest on the top of the lifting frame 34. The idler beams 52 are not provided with independent means for raising and lowering, but will rise and fall automatically as the lifting frame 34 is raised and lowered by means of the flexible cables 36.

Channel members 58 on the top of the lifting frame are adapted to selectively engage the stabilizing beams 52 to prevent the lifting frame and the load carried thereby from moving perpendicularly to the stabilizing beam 52. Appropriate antifriction means such as wheels or rollers (not shown) are provided in the channel members 58 so that the lifting frame 34 may move freely in a directly parallel to the transverse beam 12 while the stabilizing beams 52 are resting thereon.

Figure 3:
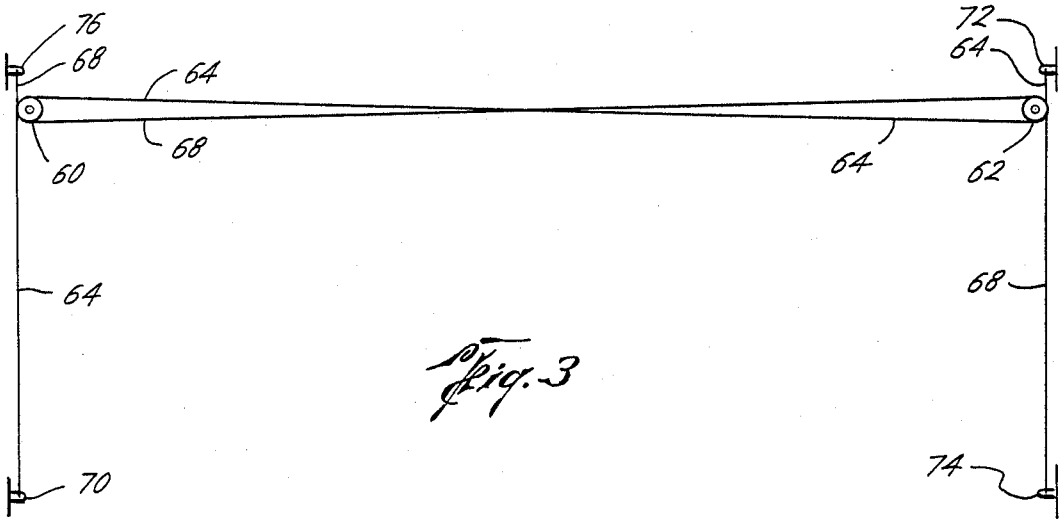
FIG. 3 is a schematic illustration of the cable reeving and pulleys for retaining the stabilizing beam of the FIG. 1 apparatus horizontal as it is raised and lowered.

Means also are provided for assuring that the stabilizer beams 52 remain always in a horizontal position, parallel to the top beam 12, regardless of the transverse position of the lifting frame 34. These means comprise a pair of double idler sheaves 60 and 62 rotatably mounted adjacent opposed ends of the idler beam 52 and a pair of flexible cables 64 and 68 reeved about the sheaves 60 and 62 and dead-ended on the structure of the gantry frame 10. As shown in FIG. 1 and in the sketch, FIG. 3, one flexible cable 64 is dead-ended at bracket 70 on one leg 14 of the gantry frame, is reeved about the top of the front sheave on double sheave 60, extends across the beam 52, is reeved about the lower portion of the back sheave of double sheave 62 and then is dead-ended at the bracket 72 on the opposite leg 14 of the gantry frame. The second cable 68 is dead-ended at bracket 74 on the gantry frame leg 14, is reeved about the top of the front sheave of double sheave 62, extends across the gantry frame, is reeved about the bottom of the back sheave of double sheave 60 and extends up to and is dead-ended at bracket 76 on the opposite leg 14 of the gantry frame. Since the cables 64 and 68 are of the same length and are taut, it will be apparent to those skilled in the art that the beam 52 always will remain horizontal and parallel to the transverse beam 12, regardless of the position of the lifting frame 34 which is used to support, raise and lower the beam 52.

The cable and reeving arrangement for retaining the stabilizing beam horizontal preferably is duplicated for both of the stabilizing beams 52.

With the apparatus as described, it will be apparent that when the idler stabilizing beams 52 are engaged by the channel members 58, the lifting frame 34 and the load carried thereby will be stabilized against sway in a direction perpendicular to the transverse gantry beams 12, while the trolley 20 and lifting frame 34 will be free to move longitudinally of the beam 12. As the lifting frame 34 and the load carried thereby are raised relative to the gantry structure by shortening the suspension cables 36, the stabilizing beams 52 resting on top of the lifting frame 34 and engaged with the channel members 58 automatically will be raised. As the lifting frame 34 and load are lowered by lengthening the suspension cables 36, the stabilizing beams 52 will be lowered along therewith, under the influence of gravity.

With the stabilizing beams thus engaged with the lifting frame 34, the bottom lifting load arms 48 may be used to lift a truck body 50 and accurately position it above the rail flatcar 72 without the trailer 50 tending to sway relative to the flatcar. Once the truck trailer is accurately positioned on the flatcar, the entire gantry frame may be advanced on its wheels 18 in order to stab the "fifth wheel" on the flatcar (not shown) into a corresponding latch (not shown) in the truck trailer body.

Figure 4:
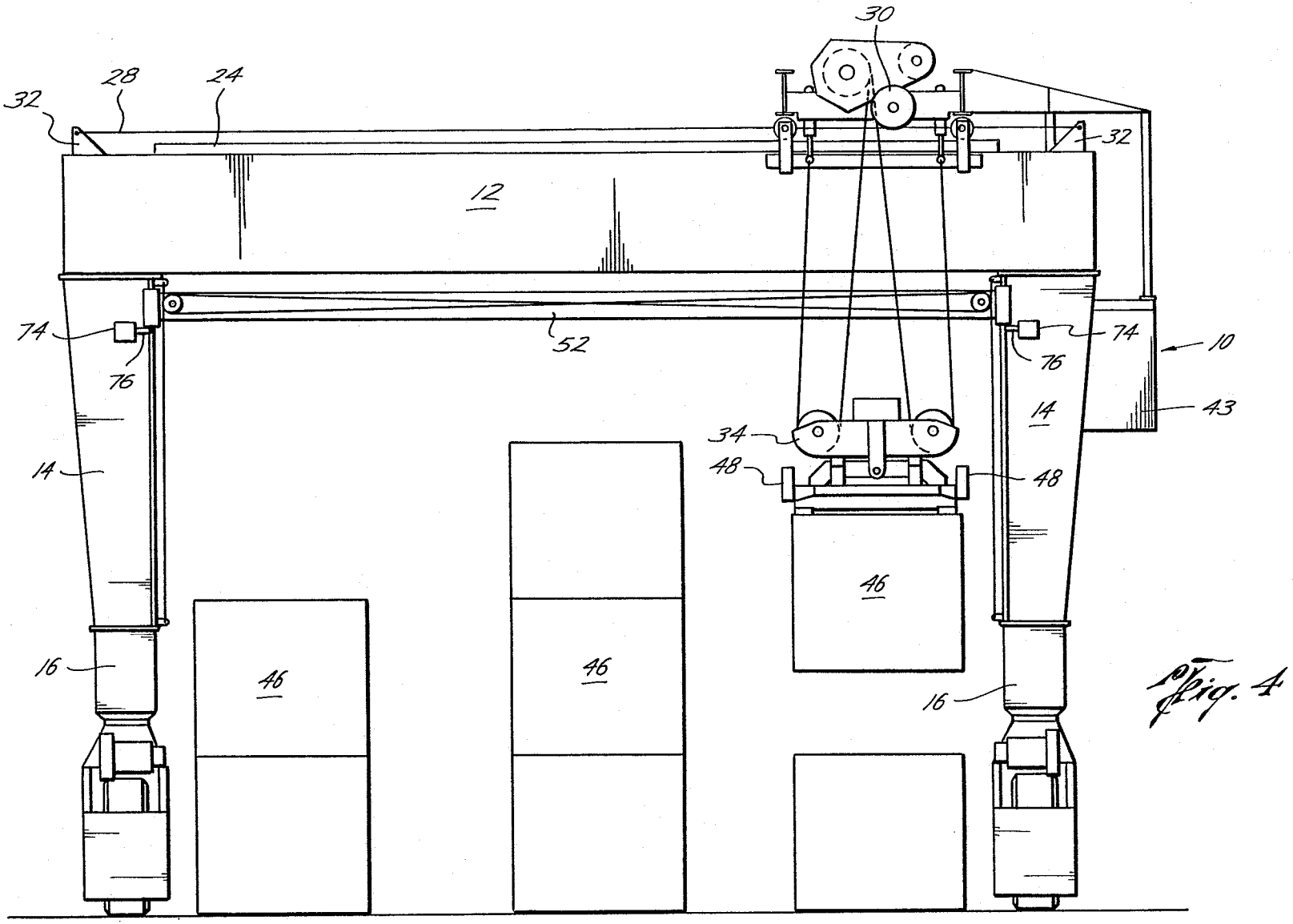
FIG. 4 is a view in front elevation showing the lifting apparatus of FIG. 1 being utilized to handle a cargo container and illustrating the stabilizing beam retained in a raised, inoperative, position.

Referring to FIG. 4, there is shown the hoisting apparatus of the present invention being utilized to handle cargo containers 46. When the containers 46 include latch receiving recesses in the upper corners thereof, the bottom lifting load arms 48 may be pivoted into a raised position, as illustrated in FIG. 4, and the container may be engaged by means of corner latches 44 on the lifting frame 34.

The legs of the gantry frame preferably are positioned far enough apart so that the gantry frame may be received over a plurality of rows of cargo containers. As shown, the containers may be stacked higher in one row than in another. If it is desired to lift or lower a container in one of the lower rows, then it may be necessary of the lifting frame 34 to extend below the top of the containers in an adjacent row. In this case, the stabilizing beams 52 would be obstructed by the top of the highest row of containers between the gantry legs, thus interfering with the operation of the gantry. To avoid this problem, there preferably are provided means for selectively retaining the stabilizer beams in a raised, inoperative, position. As illustrated, these comprise latches which may be engaged with opposed ends of the lifting beams. As shown in FIG. 4, a solenoid 74 is disposed near the upper end of each of the gantry legs 14 and a plunger 76, actuated by the solenoid, is adapted to support the bottom of the guide members 54 on each end of the stabilizing beams. When it is desired to latch the stabilizer beams in an inoperative position, the solenoids 74 are actuated to retract the plungers 76, the lifting frame 34 is raised by the cables 36 so as to place the stabilizing beams and guide members above the level of the plungers, and the solenoids are deactivated to permit the plungers 76 to be extended responsive to resilient means such as springs (not shown) internally of the solenoids. The lifting frame 34 then may be lowered free of engagement with the stabilizer beams 52, which will rest on the plungers 76. When it is desired again to use the stabilizer beams 52, they are lifted by means of the frame 34, the plungers 76 are retracted and the lifting frame and stabilizer beams are lowered below the level of the plungers 76.

From the foregoing, it will be apparent that the desired objects and advantages of the invention are accomplished by the apparatus as disclossed. The foregoing disclosure and description of the invention is illustrative only and various changes may be made in the size, shape, materials of construction and arrangement of parts, within the scope of the appended claims, without departing from the spirit of the invention.

What is claimed is:

1. A hoisting apparatus comprising a supporting structure having at least one substantially horizontal transverse beam and plural vertical leg means with wheel means for supporting said beam in such horizontal position;

a lifting frame suspended from said beam by flexible suspension means and moveable longitudinally of said transverse beam;

load engaging means on said lifting frame for releaseably engaging loads to be hoisted by said hoisting apparatus;

means associated with one of said supporting structure and said lifting frame for selectively shortening and lengthening said flexible suspension means to selectively raise and lower said lifting frame throughout a range of vertical movement;

stabilizing means vertically moveable and guided on said leg means and selectively engageable with said lifting frame for selectively stabilizing said lifting frame against movement in a direction transverse to said substantially horizontal beam throughout said range of vertical movement of said lifting frame; and means for selectively retaining said stabilizing means in an inoperative position, whereby said hoisting apparatus is adapted to operate in a first mode, with said stabilizing means operatively engaged with said lifting frame, in which first mode said lifting frame and any load carried thereby are stabilized against movement in a direction transverse to said substantially horizontal beam throughout said range of vertical movement of said lifting frame, and to operate in a second mode, without said stabilizing means operatively engaged with said lifting frame, in which second mode said lifting frame and any load carried thereby are not stabilized against movement by said stabilizing means throughout at least the majority of said range of vertical movement of said lifting frame.

2. The apparatus according to claim 1 comprising additionally a trolley mounted on said transverse beam for movement parallel to the longitudinal axis of said transverse beam and wherein said flexible suspension means are carried by said trolley.

3. The apparatus according to claim 1 wherein said stabilizing means comprise a substantially horizontal stabilizing beam guided for vertical movement by guides attached to said leg means and selectively engageable with said lifting frame and said means for retaining said stabilizing means in an inoperative position comprises means for selectively retaining said stabilizing beam in a raised position, free of engagement with said lifting frame.

4. The apparatus according to claim 3 wherein said stabilizing means comprises two substantially horizontal stabilizing beams.

5. The apparatus according to claim 3 wherein said stabilizer beam is an idler beam.

6. The apparatus according to claim 3 comprising additionally idler means for retaining said stabilizer beam substantially parallel to said transverse beam.

7. The apparatus according to claim 6 wherein said idler means for retaining said stabilizer beam substantially parallel to said transverse beam comprise a pair of idler sheaves on said stabilizer beam and a cable reeved about said sheaves and attached to said supporting structure.

8. A hoisting apparatus comprising a supporting structure having at least one substantially horizontal transverse beam and plural vertical leg means for supporting said transverse beam in such horizontal position;

a lifting frame suspended from said transverse beam by flexible suspension means and moveable longitudinally of said transverse beam;

load engaging means on said lifting frame for releaseably engaging loads to be hoisted by said hoisting apparatus;

means associated with one of said supporting structure and said lifting frame for selectively shortening and lengthening said flexible suspension means to selectively raise and lower said lifting frame throughout a range of vertical movement;

a substantially horizontal stabilizing beam on said supporting structure guided adjacent each of its ends on said leg means for vertical movement relative to said transverse beam;

means for selectively engaging said stabilizing beam with said lifting frame, whereby said lifting frame may be substantially stabilized against sway relative to said supporting structure throughout said range of vertical movement of said lifting frame; and means for selectively retaining said stabilizing beam in a position free of engagement with said lifting frame, whereby said hoisting apparatus is adapted to operate in a first mode, with said stabilizing beam engaging said lifting frame, in which first mode said lifting frame and any load carried thereby are substantially stabilized against sway relative to said supporting structure throughout said range of vertical movement of said lifting frame, and to operate in a second mode, with said stabilizing beam retained in a position free of engagement with said lifting frame, in which second mode said lifting frame and any load carried thereby are not substantially stabilized against sway by said stabilizing beam throughout at least the majority of said range of vertical movement of said lifting frame.

9. The apparatus according to claim 8 wherein said stabilizing beam is an idler beam adapted to be raised and lowered along with said lifting frame.

10. The apparatus according to claim 8 comprising additionally idler means for retaining said stabilizing beam in a substantially horizontal position.

11. The apparatus according to claim 10 wherein said means for retaining said stabilizing beam in a substantially horizontal position comprise a pair of idler sheaves on said stabilizing beam and a pair of cables reeved about said idler sheaves and attached to said supporting structure.

12. The apparatus according to claim 8 comprising additionally guide means attached to said leg means of said supporting structure for guiding said stabilizer beam on said leg means for vertical movement relative to said transverse beam.

13. The apparatus according to claim 8 comprising additionally a trolley mounted on said transverse beam for movement parallel to the longitudinal axis of said transverse beam and wherein said flexible suspension means are carried by said trolley.

14. The apparatus according to claim 8 including two substantially horizontal stabilizing beams.

15. The apparatus according to claim 8 wherein said load engaging means on said lifting frame comprise both means for selectively engaging the tops of cargo containers to be lifted by said hoisting apparatus and pivotal load engaging arms for selectively engaging the bottom of truck trailers to be lifted by said hoisting apparatus.

16. A self-mobile hoisting apparatus comprising:

a unitary gantry structure comprising a substantially horizontal transverse beam, and a pair of supporting legs for said horizontal transverse beam to form said unitary gantry structure;

guidable, moveable wheels supporting said legs whereby said unitary gantry structure may move along the ground in any desired direction;

a moveable trolley positioned on said horizontal transverse beam of said unitary gantry structure and moveable longitudinally thereof;

a lifting frame suspended from said trolley by flexible suspension means;

load engaging means on said lifting frame for releaseably engaging loads to be hoisted by said hoisting apparatus;

means associated with one of said trolley and said lifting frame for selectively shortening and lengthening said flexible suspension means to selectively raise and lower said lifting frame throughout a range of vertical movement;

a substantially horizontal stabilizing beam guided on said legs for vertical movement relative to said transverse beam;

means for selectively engaging said stabilizing beams with said lifting frame, whereby said lifting frame and any load carried thereby may be stabilized against sway relative to said gantry structure throughout said range of vertical movement of said lifting frame; and means for selectively retaining said stabilizing beam in a raised position free of engagement with said lifting frame, whereby said lifting frame and any load carried thereby may be operated throughout at least most of said range of vertical movement of said lifting frame free of engagement with said stabilizing beam.

17. The apparatus according to claim 16 wherein said stabilizing beam is an idler beam adapted to be raised and lowered along with said lifting frame.

18. The apparatus according to claim 17 comprising additionally idler means for retaining said stabilizing beam in a substantially horizontal position, said idler means comprising a pair of idler sheaves on said stabilizing beam and a pair of cables reeved about said idler sheaves on said stabilizing beam and attached to said gantry structure.

19. The apparatus according to claim 16 wherein said load engaging on said lifting frame comprises both means for selectively engaging the tops of cargo containers to be lifted by said hoisting apparatus and pivotal load engaging arms for selectively engaging the bottom of truck trailers to be lifted by said hoisting apparatus.

* * * * *